US005331765A

United States Patent [19]

Dupuis et al.

[11] Patent Number: 5,331,765

[45] Date of Patent: Jul. 26, 1994

[54] ADJUSTING DEVICE FOR A DOUBLE-HUNG SASH ASSEMBLY, IMPROVED ASSEMBLY SO OBTAINED AND METHOD OF USE

[75] Inventors: Jean Dupuis, Montréal; Nick Ganos, St-Louis-de-Terrebonne, both of Canada

[73] Assignee: Les Produits ABP, Inc., Quebec, Canada

[21] Appl. No.: 970,072

[22] Filed: Nov. 2, 1992

[51] Int. Cl.[5] ..... E05F 17/00

[52] U.S. Cl. ..... 49/121; 49/445

[58] Field of Search ..... 49/121, 123, 119, 445, 49/446, 506

[56] References Cited

U.S. PATENT DOCUMENTS

| | | | |
|---|---|---|---|
| 1,916,681 | 7/1933 | Nagel | 49/121 X |
| 2,901,768 | 9/1959 | Decker et al. | 16/202 |
| 3,084,377 | 4/1963 | Foster | 16/197 |
| 3,150,420 | 9/1964 | Brenner | 49/445 |
| 3,331,156 | 7/1967 | Tremblay et al. | 49/194 |
| 3,358,403 | 12/1967 | Dinsmore et al. | 49/445 |
| 3,381,415 | 5/1968 | Nachtsheim | 49/445 |
| 3,466,806 | 9/1969 | Teggelaar et al. | 49/445 |
| 3,475,864 | 11/1969 | Wood | 49/445 |
| 3,500,586 | 3/1970 | Johnson | 49/431 |
| 3,600,854 | 8/1971 | Dallaire et al. | 49/121 |
| 3,945,149 | 3/1976 | Boucher | 49/121 |
| 4,914,780 | 4/1990 | Rogers et al. | 16/193 |

*Primary Examiner*—Philip C. Kannan
*Attorney, Agent, or Firm*—Michael D. Bednarek

[57] ABSTRACT

A device for fine adjustment of sashes in a double-hung sash assembly of the type comprising four movable sashes linked two by two by a set of two cables located on each side of the window frame and supported by four pulleys. At least two pulleys, and preferably four, are operatively attached to a support slidably mounted in a vertical rail provided in a housing. Each support is moved by means of a screw for adjusting relative positions of sashes, each screw comprising an upper end abutting on or operatively attached to one of the supports, an intermediary portion meshed to an element integral with the housing and a lower end downwardly projecting from the housing and preferably operable with a screwdriver. It allows fine adjustment of the relative position of a pair of sashes linked together to thus allow them to close simultaneously.

17 Claims, 4 Drawing Sheets

ADJUSTING DEVICE FOR A DOUBLE-HUNG SASH ASSEMBLY, IMPROVED ASSEMBLY SO OBTAINED AND METHOD OF USE

FIELD OF THE INVENTION

The present invention relates to an adjusting device for fine adjustment of sashes in a double-hung sash assembly of the type comprising four movable panes linked two by two by cables, to an improved double-hung sash assembly comprising said device and to a method of use.

DESCRIPTION OF PRIOR ART

Double-hung sash assemblies comprise four sashes disposed in adjacent pairs, each pair comprising an upper sash and a lower sash. One of the pairs, hereinafter called "the first pair", is facing the interior and the other pair, hereinafter called "the second pair", is facing the exterior.

In the double-hung sash assembly, the lower sash of the first pair is linked by a cable to the upper sash of the second pair, and the upper sash of the first, pair is inked to the lower sash of the second pair. When one sash is opened or closed, the corresponding sash is opened or closed in the same time. For example, one can open the lower sash of the first pair by lifting it on a given distance ana the upper sash of the second pair will also open by descending of the same distance.

The main advantages to that interrelation between the sashes of the two pairs is that it allows to obtain an indirect airstream by only moving one sash since the other sash of the other pair moves at the same time, and that is allows the weight of each sash to be counterbalanced by the weight of their corresponding sash. Example of such double device is disclosed in U.S. Pat. No. 3,331,156.

Yet the main drawback of the above-described double sash assembly is that it is difficult to adjust to have two sashes linked together to close simultaneously. It is particularly important in cold weather to avoid a misadjustment of the sashes because otherwise it may result in an important energy loss through the window.

According to the prior art, the adjustments were made by changing the length of the cables until a suitable level of adjustment is obtained. However, this usually has to be done by a skilful workman and takes a long time.

Additionally, the adjustment may be altered over the years because of numerous factors, such as creep or humidity in the window frame. When such adjustment becomes unsuitable, the workman has to be called in for performing another adjustment.

SUMMARY OF THE INVENTION

The object of the present invention is to provide a device allowing a double-hung sash assembly to be easily adjusted by anyone, including a person unskilful in the art of sash adjustment.

Another object of the invention is to provide a device that is inexpensive to manufacture, reliable and easy to install.

Advantageously, the invention relates to an improvement in a double-hung each assembly of the type comprising:

two adjacent first and second pairs of sashes sliding in a window frame, each pair comprising an upper sash and a lower sash;

at least one set of four pulleys operatively mounted in a housing mounted on said window frame, each pulley of a same set being substantially aligned with one of said sashes; and for each set of four pulleys:

a first cable having two ends, one of said ends being fixed to said upper sash of said first pair and the other end being fixed to said lower sash of said second pair, said first cable being supported by two of said pulleys aligned with said sashes having an end of said first cable fixed thereto;

a second cable having two ends, one of said ends being fixed to said lower sash of said first pair and the other end being fixed to said upper sash of said second pair, said second cable being supported by two of said pulleys aligned with said sashes having an end of said second cable fixed thereto.

This improvement is characterized for each set of four pulleys by providing adjusting means for modifying the relative distance between at least one pulley of those supporting the first cable and its corresponding sash, and/or modifying the relative distance between at least one pulley of those supporting the second cable and its corresponding sash.

More particularly, aforesaid adjusting means may comprises:

at least two rails provided in the housing;

at least two supports, each support being slidably mounted in a corresponding rail; either one pulley of those supporting the first cable, being operatively mounted to a corresponding support, of each of said pulleys supporting the first cable being either respectively operatively mounted to a corresponding support or operatively mounted to a common support; and either one pulley of those supporting the second cable, being operatively mounted to a corresponding support, or each of said pulley supporting the second cable being either respectively operatively mounted to a corresponding support or operatively mounted to a common support; and means for individually moving each of said supports along its corresponding rail to this adjust the relative distance between a pulley and its corresponding sash.

It is also another object of the invention to provide a device for adjusting a double-hung sash assembly comprising:

two adjacent first and second pairs of sashes sliding in a window frame, each pair comprising an upper sash and a lower sash;

a first cable having two ends, one of said ends being fixed to said upper sash of said first pair and the other end being fixed to said lower sash of said second pair; and a second cable having two ends, one of said ends being fixed to said lower sash of said first pair and the other end being fixed to said upper sash of said second pair;

said device comprising:

a housing adapted to be mounted on said window frame, and advantageously provided with means to firmly fasten it on said window frame;

a set of four pulleys operatively mounted in the housing, each pulley being intended to be substantially aligned with one of said sashes; and adjusting means for modifying the relative distance between at least one pulley of those intended to support the first cable and a corresponding sash which is intended to be aligned with said pulley and fixed to a corresponding end of the first cable, and/or modifying the relative distance between at least one pulley of those intended to support the second cable and a corresponding sash which is intended to be aligned with said pulley and fixed to a corresponding end of the second cable.

It is still another object of the invention to provide a method for adjusting an improved double-hung sash assembly as defined hereinabove, wherein for each set of four pulleys:

when the length of the first cable fixed to the upper sash of the first pair and the lower sash of the second pair is either too long or too short to close both sashes simultaneously, at least one pulley of these supporting said first cable is moved to modify its relative distance with respect to its corresponding sash and thus set a path between both sashes through said pulleys that equals the length of the first cable, when the length of the second cable fixed to the lower sash of the first pair and the upper sash of the second pair is either too long or too short to close both sashes simultaneously, at least one pulley of those supporting the second cable is moved to modify its relative distance with respect to its corresponding sash and thus set a path between both sashes through said pulleys that equals the length of the second cable.

A non restrictive description of a preferred embodiment will now be given with reference to the appended drawings.

DESCRIPTION OF A PREFERRED EMBODIMENT

The improved double sash assembly according to a preferred embodiment of the invention are shown in the appended drawings.

Figure 3:
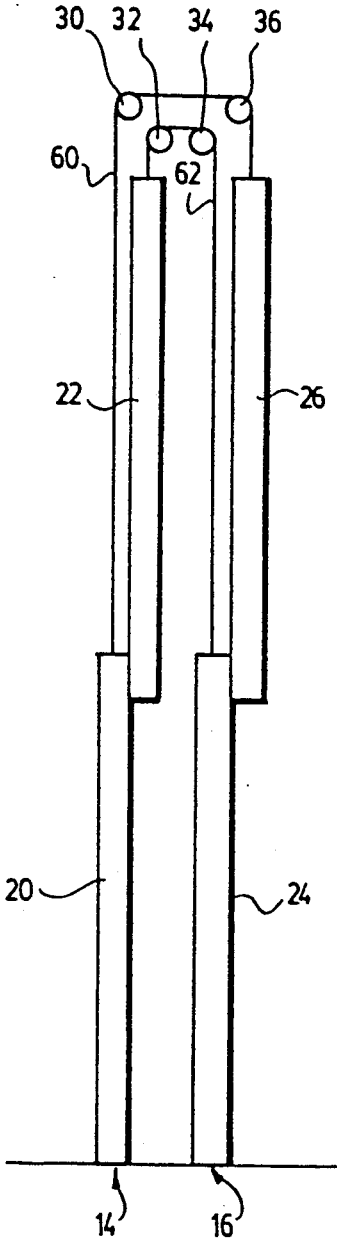
FIG. 3 is a schematic side elevational view of a double-hung sash assembly with the sashes in a closed position.
Figure 4:
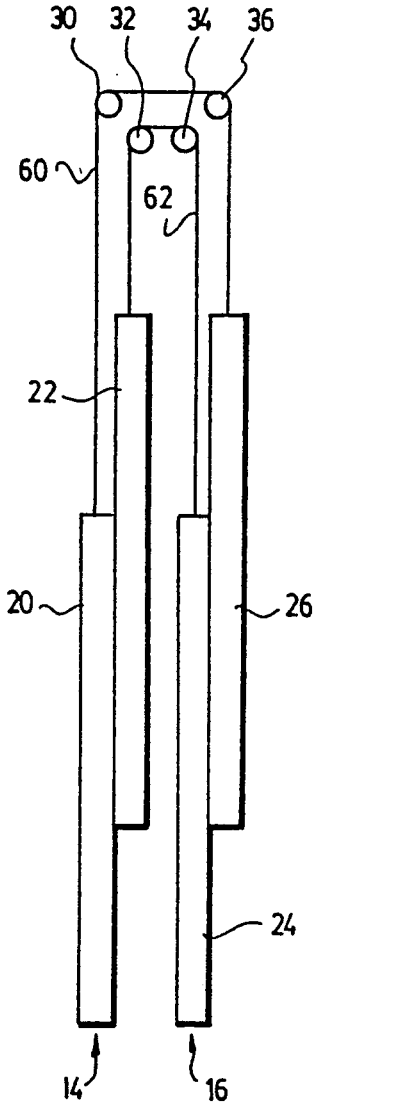
FIG. 4 is a schematic side elevational view of a double-hung sash assembly with the sashes in an opened position.

As shown in FIGS. 3 and 4, the double-hung sash assembly comprises two adjacent pairs of sashes, the first pair 14 and the second pair 16, sliding in a window frame (not shown). The first pair 14 is facing the interior and the second pair 16 is facing the exterior.

The first pair 14 comprises a lower sash 20 and an upper sash 22. The second pair 16 comprises a lower sash 24 and an upper sash 26.

Figure 5:
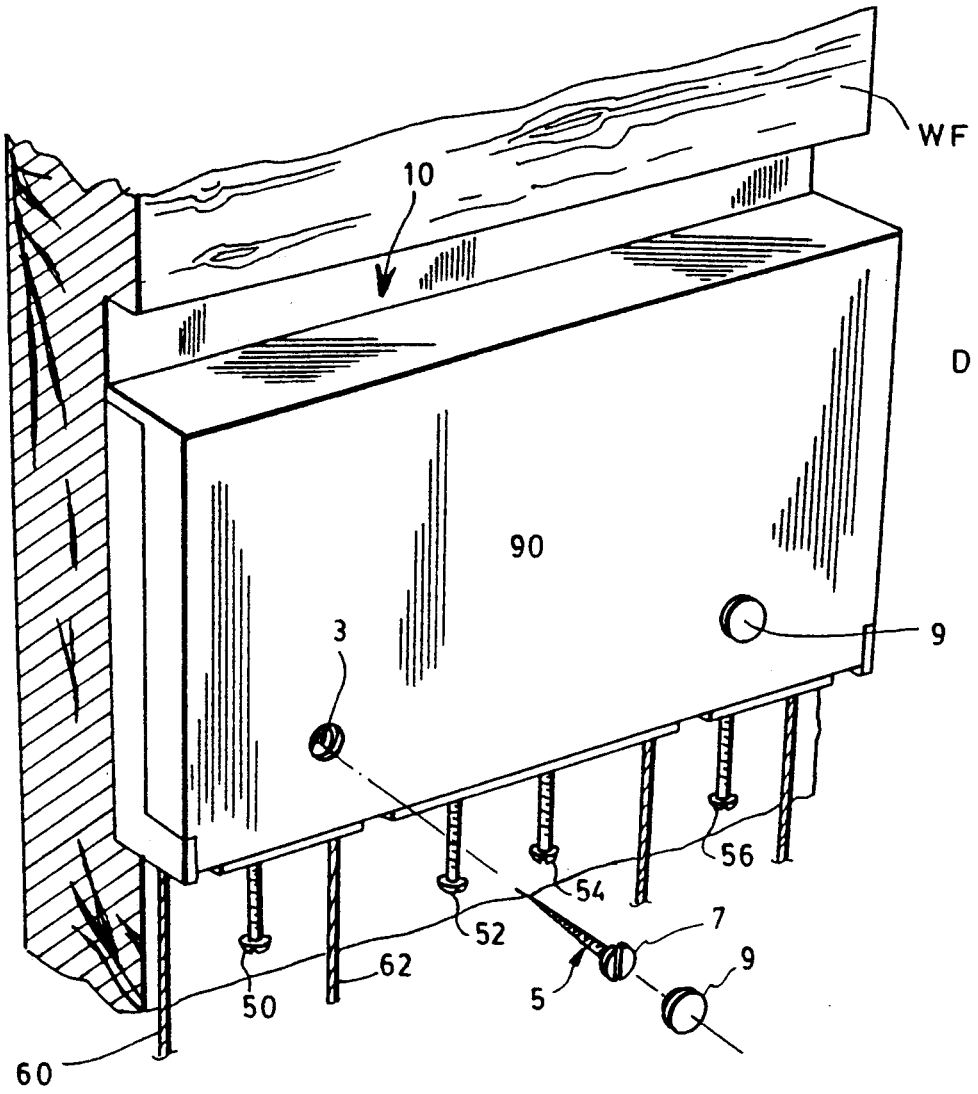
FIG. 5 is a perspective view of the housing with the cover.

A set of four pulleys 30, 32, 34 and 36, mounted in a housing 10 located in the window frame (FIGS. 1 and 5), are conventionally mounted in the left and/or the right upper sides of the window frame. Advantageously, the use of two sets, that is one on each side of the window, allows the sashes to slide more easily. The pulleys 30, 32, 34 and 36 are substantially aligned respectively with the sashes 20, 22, 24 and 26. A removable cover 90 may close the housing 10. This cover 90 may be removed to make easier the introduction of cables 60, 62 on corresponding pulleys.

For each set of four pulleys, a first cable 62 having two ends, one of said ends being fixed to said upper sash 22 of said first pair and the other end being fixed to said lower sash 24 of said second pair, said first cable 62 being supported by two of said pulleys, that is pulleys 32, 34, aligned with said sashes 22, 24 having an end of said first cable 62 fixed thereto;

a second cable 60 having two ends, one of said ends being fixed to said lower sash 20 of said first pair and the other end being fixed to said upper sash 26 of said second pair, said second cable 60 being supported by two of said pulleys, that is pulleys 30, 36, aligned with said sashes 20, 26, having an end of said second cable 60 fixed thereto; the improvement wherein adjusting means are provided for modifying the relative distance between at least one pulley of those (i.e. pulleys 32, 34) supporting said first cable 62 and its corresponding sash (22, 24), and/or modifying the relative distance between at least one pulley of those (i.e. pulleys 30, 36) supporting said second cable 60 and its corresponding sash (20, 26).

The cables 60 and 62 may also be chains, cords in other similar elements.

Advantageously, said adjusting means may comprise:

at least two rails 11 provided in the housing 10, at least two supports, each support being slidably mounted in a corresponding rail 11, either one pulley of those (i.e. pulleys 32, 34) supporting the first cable 62, being operatively mounted to a corresponding support, or each of said pulleys supporting the first cable 62 being either respectively operatively mounted to a corresponding support or operatively mounted to a common support 45; and either one pulley of those (i.e. pulleys 30, 36) supporting the second cable 60 being operatively mounted to a corresponding support, or each of said pulleys supporting the second cable being either respectively operatively mounted to a corresponding support or operatively mounted to a common support (not shown and similar to the support 45); and means for individually moving each of said supports along its corresponding rail 11 to adjust the relative distance between a pulley and its corresponding sash.

Figure 1:
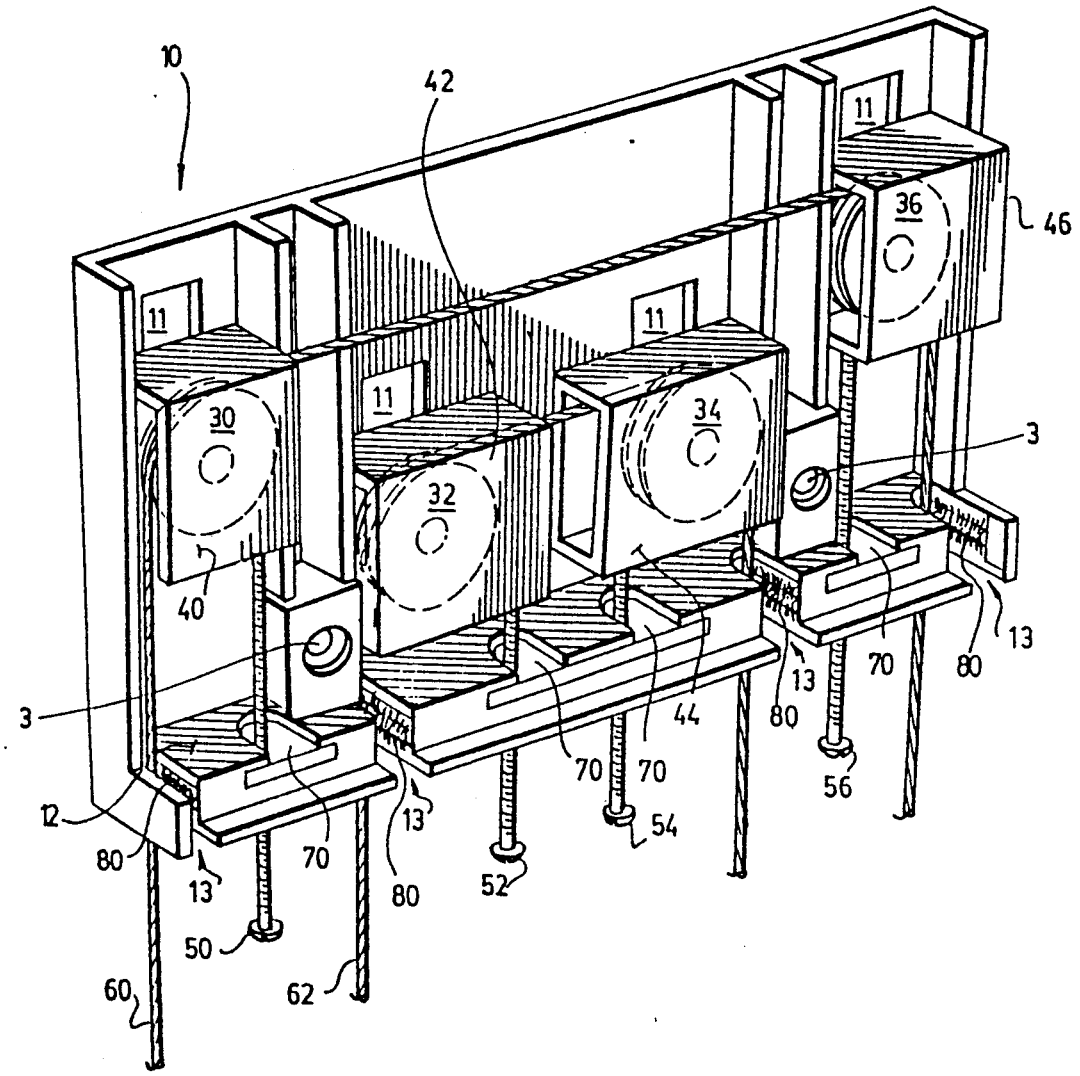
FIG. 1 is a cross-sectional perspective view of the housing of an improved double-hung sash assembly according to the invention.

Preferably, as shown in FIG. 1, pulleys 30, 32, 34 and 36 may be each operatively attached respectively to a support 40, 42, 44 and 46. Each support is slidably mounted in a rail 11 provided in the housing 10.

Figure 2:
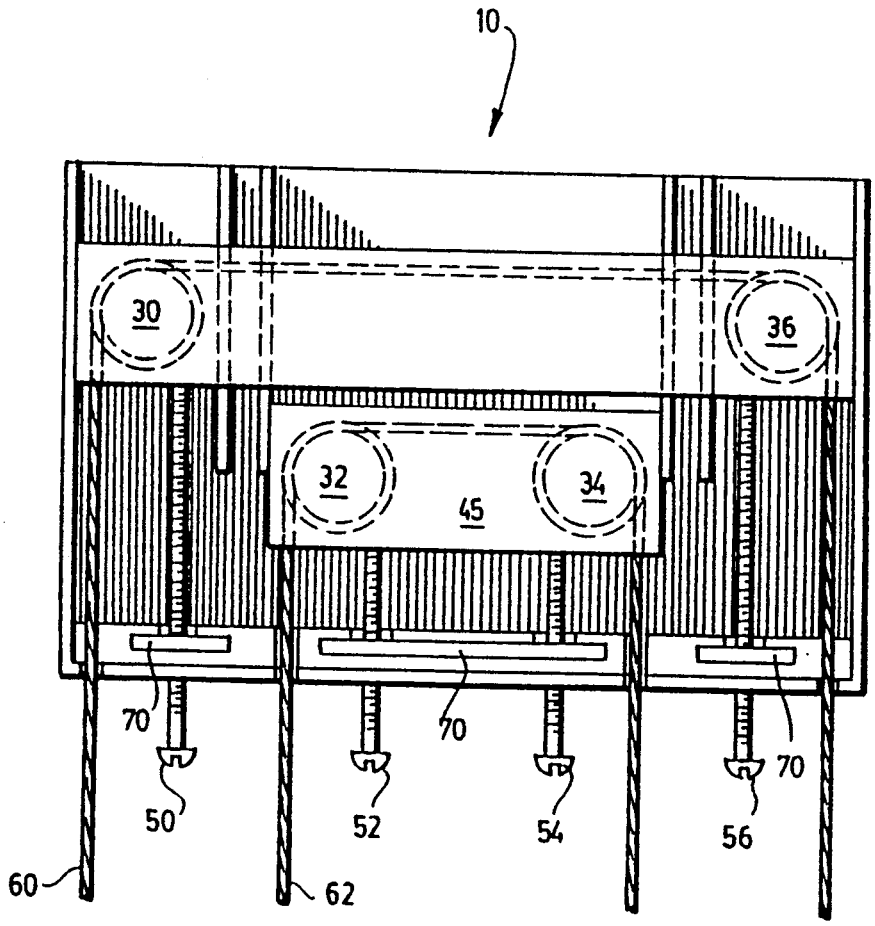
FIG. 2 is a front elevational view of the housing of a variant of an improved double-hung sash assembly according to the invention.

Preferably, as shown in FIG. 2, supports 42 and 44 may be optionally combined into a common support 45. The supports 40 and 46 may also be combined into a common support (not shown).

The invention also relates to a device D for adjusting aforesaid double-hung sash assembly. This device D advantageously comprise:

a housing 10 intended to be mounted in said window frame WF, a set of four pulleys 30, 32, 34, 36 operatively mounted in the housing, each pulley being intended to be substantially aligned with one of said sashes 20, 22, 24, 26; and adjusting means for modifying the relative distance between at least one pulley of those (that is pulleys 32, 34) intended to support the first cable 62 and a corresponding sash (i.e. sashes 22, 24) which is intended to be aligned with said pulley and fixed to a corresponding end of the first cable 62, and/or modifying the relative distance between at least one pulley of those (i.e. pulleys 30, 36) intended to support the second cable 60 and a corresponding sash (i.e. sashes 20, 26) which is intended to be aligned so with said pulley and fixed to a corresponding end of the second cable 60.

Advantageously, means for individually moving each of said supports may comprise, for each support, an element integral with a lower portion of said housing 10, and a screw having an upper end abutting against or operatively attached to said support, an intermediary portion meshed to the element integral with said housing and a lower end projecting from said housing and intended to be engaged by driving means (such as a screwdriver).

Preferably, means for individually moving each supports 40, 42, 44 and 46 (in FIG. 1) or supports 40, 45 and 46 in FIG. 2, along its corresponding rail 11 to adjust the relation distance between a pulley and its corresponding sash, may consist of screws 50, 52, 54 and 56. Each screw has an upper end abutting against a corresponding support, an intermediary portion meshed to an element integral with the housing 10, such as a metal insert 70, defining a bottom 12 to the housing 10 and is provided with holes through which the first cable 62 and the second cable 60 penetrates, and a lower end projecting from the housing 10 and intended to be engaged by driving means (e.g. a screw driver). In the case of the metal inserts 70, they are provided with a threaded hole (not shown) sized to received said screws 50, 52 54 and 56.

In the case of a common support, such as the common support 45, there is the possibility of having only one screw instead of two as shown in FIG. 2.

The lower end of the screws downwardly projecting from the housing 10 are adjacent to the window frame or inside an enclosure provided therein. The housing 10 may have a portion thereof within the window frame and another portion slightly projecting therefrom. The screws are then adjacent to the sashes. However, this is not essential since a groove in the window frame may be provided to give clearance to the ends of the screws.

According to a particularly preferred embodiment of the invention a housing 10 may be provided on each side of the window frame. Advantageously, each casing 10 may be fastened to the window frame by any appropriate means well known in the art such as those using screws, glue, etc.

Preferably, means for fastening said device D to a window frame WF may consist of a bore 3, preferably two bores 3, through which a screw 5 provided with a head 7 is engaged. The screw 5 is driven in the window frame WF and the head 7 presses the device D against the window frame WF. The head 7 of a screw may be hidden with a small cap 9.

The improvement set forth in the present invention provides adjusting means for modifying the relative distance between at least one pulley of those supporting the first cable and its corresponding sash, and/or modifying the relation distance between at least one pulley of those supporting the second cable and its corresponding sash.

As aforesaid, when one sash is opened or closed, the corresponding sash is opened or closed at the same time. For example, one can open the lower sash 20 by lifting it on a given distance and the upper sash 26 will also open by descending of the same distance. It allows to obtain an indirect airstream by only moving one sash since the other sash of the other pair moves at the same time. It also allows the weight of each sash to be counterbalanced by the weight of their corresponding sash.

When the sashes are installed and the adjustment process is carried on, the end of the screws is accessible by means of a tool such as a screwdriver. By turning the screws 50, 52, 54 and 56, the corresponding supports, respectively 40, 42, 44 and 46, will slide of a distance proportional to the number of turns of their corresponding screw. By changing the position of the supports, it thus also changes the position of the pulleys and modifies the relative position of the sashes, relative position meaning the positions of the sashes linked to the same cable 60 or 62. When a pulley is raised, the corresponding sash is also raised. When a pulley is lowered, the corresponding sash is lowered.

The main goal of adjusting the relative position of the sashes is to get them to close simultaneously because otherwise, if a sash is not fully closed, there may be air infiltration, thus energy lost, especially when the outside temperature is cold.

of course, there can only be one sliding support for each cable, the other being fixed, but a four-screw system is preferable because more flexible and easier to use.

The double-hung sash assembly may further comprise insulation means, such as insulation bristles 80, located in holes 13 provided in the bottom portion 12 of the housing 10 in which the first cable 62 and second cable 60 penetrate into the housing 10. The insulation bristles 80 allow the cables 60 and 62 to be moved freely and prevent an excessive airflow to go into the housing 10.

Finally, there is also provided a method for adjusting a double-hung sash window, wherein:

when the length of the first cable 62 fixed to the upper sash 22 of the first pair 14 and the lower sash 24 or the second pair 16 is either too long or too short to close both sashes simultaneously, at least one pulley of those supporting the first cable 62 is moved to modify its relative distance with respect to its corresponding sash and thus set a patch between both sashes through said pulleys that equals the length of the first cable 62, when the length of the second cable 60 fixed to the lower sash 20 of the first pair 14 and the upper sash 26 of the second pair 16 is either too long or too short to close both sashes simultaneously, at least one pulley of those supporting the second cable 60 is moved to modify its relative distance with respect to its corresponding sash and thus set a path between both sashes through the pulleys that equals the length of the second cable 60.

Of course, if the double-hung sash window comprise two devices according to the invention, both devices are adjusted.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What I claim is:

1. In a double-hung sash assembly comprising:

two adjacent first and second pairs of sashes sliding in a window frame, each pair comprising an upper sash and a lower sash;

at least one set of four pulleys operatively mounted in a housing mounted in said window frame, each pulley of a same set being substantially aligned with one of said sashes; and for each set of four pulleys:

a first cable having two ends, one of said ends being fixed to said upper sash of said first pair and the other end being fixed to said lower sash of said second pair, said first cable being supported by two of said pulleys aligned with said sashes having an end of said first cable fixed thereto;

a second cable having two ends, one of said ends being fixed to said lower sash of said first pair and the other end being fixed to said upper sash of said second pair, said second cable being supported by two of said pulleys aligned with said sashes having an end of said second cable fixed thereto;

the improvement wherein for each set of four pulleys adjusting means are provided for modifying the relative distance between at least one pulley of those supporting said first cable and its corresponding sash, and/or modifying the relative distance between at least one pulley of those supporting said second cable and its corresponding sash; and wherein said adjusting means comprise:

at least two rails provided in the housing;

at least two supports, each support being slidably mounted in a corresponding rail;

at least one pulley of those supporting the first cable, being operatively mounted to a support, and at least one pulley of those supporting the second cable being operatively mounted to a support, and means for individually moving each of said supports along its corresponding rail to adjust the relative distance between a pulley and its corresponding sash.

2. An improved sash assembly according to claim 1, wherein two sets of four pulleys are mounted on the window frame.

3. An improved double-hung sash assembly according to claim 1, wherein said means for individually moving each of said supports comprise, for each support, an element integral with a lower portion of said housing, and a screw having an upper end abutting against or operatively attached to said support, an intermediary portion meshed to the element integral with said housing and a lower end projecting from said housing and intended to be engaged by driving means.

4. An improved double-hung sash assembly according to claim 3, wherein the element integral with a lower portion of the housing defined a bottom to said housing and is provided with holes through which said first and second cables penetrate, said holes being further provided with insulation means.

5. In a double-hung sash assembly comprising:

two adjacent first and second pairs of sashes sliding in a window frame, each pair comprising an upper sash and a lower sash;

at least one set of four pulleys operatively mounted in a housing mounted in said window frame, each pulley of a same set being substantially aligned with one of said sashes; and for each set of four pulleys:

a first cable having two ends, one of said ends being fixed to said upper sash of said first pair and the other end being fixed to said lower sash of said second pair, said first cable being supported by two of said pulleys aligned with said sashes having an end of said first cable fixed thereto;

a second cable having two ends, one of said ends being fixed to said lower sash of said first pair and the other end being fixed to said upper sash of said second pair, said second cable being supported by two of said pulleys aligned with said sashes having an end of said second cable fixed thereto;

the improvement wherein for each set of four pulleys, adjusting means are provided for adjusting the relative distance between each pulley and its corresponding sash, said adjusting means comprising:

four rails provided in the housing;

four supports, each support being slidably mounted in a corresponding rail; each pulley of those supporting the first cable being respectively operatively mounted to a corresponding support, and each pulley of those supporting the second cable being respectively operatively mounted to a corresponding support; and means for individually moving each of said support along its corresponding rail to thus adjust the relative distance between a pulley and its corresponding sash, said means comprising, for each support:

an element integral with a lower portion of the housing, a screw having an upper end abutting against or operatively attached to said support, an intermediary portion meshed to the element integral with the housing and lower end projecting from said housing and intended to be engaged by driving means.

6. An improved sash assembly according to claim 5, wherein the element integral with a lower portion of the housing defines a bottom to said housing and is provided with holes through which said first and second cables penetrate, said holes being further provided insulation means.

7. In a double-hung sash assembly comprising:

two adjacent first and second pairs of sashes sliding in a window frame, each pair comprising an upper sash and a lower sash;

at least one set of four pulleys operatively mounted in a housing mounted in said window frame, each pulley of a same set being substantially aligned with one of said sashes; and for each set of four pulleys:

a first cable having two ends, one of said ends being fixed to said upper sash of said first pair and the other end being fixed to said lower sash of said second pair, said first cable being supported by two of said pulleys aligned with said sashes having an end of said first cable fixed thereto;

a second cable having two ends, one of said ends being fixed to said lower sash of said first pair and the other end being fixed to said upper sash of said second pair, said second cable being supported by two of said pulleys aligned with said sashes having an end of said second cable fixed thereto;

the improvement wherein for each set of four pulleys, adjusting means are provided for adjusting the relative distance between each pulley and its corresponding sash, said adjusting means comprising:

three rails provided in the housing;

three supports, each support being slidably mounted in a corresponding rail; each pulley of those supporting the second cable being operatively mounted to a common support; and means for individually moving each of said support along its corresponding rail to thus adjust the relative distance between a pulley and its corresponding sash, said means comprising, for each support:

an element integral with a lower portion of the housing, a screw having an upper end abutting against or operatively attached to said support, an intermediary portion meshed to the element integral with the housing and lower end projecting from said housing and intended to be engaged by driving means.

8. An improved sash assembly according to claim 7, wherein the element integral with a lower portion of the housing defines a bottom to said housing and is provided with holes through which said first and second cables penetrate, said holes being further provided insulation means.

9. A device for adjusting a double-hung sash assembly of the type comprising:

two adjacent first and second pairs of sashes sliding in a window frame, each pair comprising an upper sash and a lower sash;

a first cable having two ends, one of said ends being fixed to said upper sash of said first pair and the other end being fixed to said lower sash of said second pair; and a second cable having two ends, one of said ends being fixed to said lower sash of said first pair and the other end being fixed to said upper sash of said second pair; said device comprising:

housing adapted to be mounted on said window frame, a set of four pulleys operatively mounted in the housing, each pulley being intended to be substantially aligned with one of said sashes;

adjusting means for modifying the relative distance between at least one pulley of those intended to support the first cable and a corresponding sash which is intended to be aligned with said pulley and fixed to a corresponding end of the first cable, and/or modifying the relative distance between at least one pulley of those intended to support the second cable and a corresponding sash which is intended to be aligned with said pulley and fixed to a corresponding end of the second cable; and wherein said adjusting means comprises:

at least two rails provided in the housing;

at least two supports, each support being slidably mounted in a corresponding rail;

at least one pulley of those intended to support the first cable, being operatively mounted to a support; and at least one pulley of those intended to support the second cable, being operatively mounted to a support, and means for individually moving each of said supports along its corresponding rail to thus adjust the relative distance between a pulley and its corresponding sash.

10. A device according to claim 9, wherein said means for individually moving each of said supports comprise for each support, an element integral with a lower portion of said housing, and a screw having an upper end abutting against or operatively attached to said support, an intermediary portion meshed to the element integral with said housing and a lower end projecting from said housing and adapted to be engaged by driving means.

11. A device according to claim 10, wherein the element integral with a lower portion of the housing defines a bottom to said housing and is provided with holes through which said first and second cables penetrate, said holes being further provided with insulation means.

12. A device according to claim 9, wherein said adjusting means comprises:

four rails provided in the housing;

four supports, each support being slidably mounted in a corresponding rail; each pulley of those intended to support the first cable being respectively operatively mounted to a corresponding support, and each pulley of those supporting the second cable being respectfully operatively mounted to a corresponding support; and means for individually moving each of said supports along its corresponding rail to thus allow to adjust the relative distance between a pulley and its corresponding sash, said means comprising, for each support:

an element integral with a lower portion of the housing, a screw having an upper end abutting against or operatively attached to said support, an intermediate portion meshed to the element integral with the housing and a lower end projecting from said housing and intended to be engaged by driving means.

13. A device according to claim 12, wherein the element integral with a lower portion of the housing defines a bottom to said housing and is provided with holes through which said first and second cables penetrate, said holes being further provided with insulation means.

14. A device according to claim 9, wherein said adjusting means comprises:

three rails provided in the housing;

three supports, each support being slidably mounted in a corresponding rail; each pulley of those intended to support the first cable being respectively operatively mounted to a corresponding support, and each pulley of those supporting the second cable being operatively mounted to a common support; and respectfully operatively mounted to a corresponding support; and means for individually moving each of said supports along its corresponding rail to thus allow to adjust the relative distance between a pulley and its corresponding sash, said means comprising, for each support:

an element integral with a lower portion of the housing, a screw having an upper end abutting against or operatively attached to said support, an intermediate portion meshed to the element integral with the housing and a lower end projecting from said housing and intended to be engaged by driving means.

15. A device according to claim 14, wherein the element integral with a lower portion of the housing defines a bottom to said housing and is provided with holes through which said first and second cables penetrate, said holes being further provided with insulation means.

16. A device according to claim 9, wherein it is further provided with means allowing to firmly fasten it on a window frame.

17. A method for adjusting an improved double-hung sash assembly as defined in claim 1, wherein for each set of four pulleys:

when the length of the first cable fixed to the upper sash of the first pair and the lower sash of the second pair is either too long or too short to close both sashes simultaneously, at least one pulley of those supporting said first cable is moved to modify its relative distance with respect to its corresponding sash and thus set a patch between both sashes through said pulleys that equals the length of the first cable, when the length of the second cable fixed to the lower sash of the first pair and the upper sash of the second pair is either too long or too short to close both sashes simultaneously, at least one pulley of those supporting the second cable is moved to modify its relative distance with respect to its corresponding sash and thus set a path between both sashes through said pulleys that equals the length of the second cable.

* * * * *